United States Patent [19]

Conn

[11] 4,334,338

[45] Jun. 15, 1982

[54] SEPARABLE HINGE

[76] Inventor: John L. Conn, P.O. Box 4501-Sta. B, Spartanburg, S.C. 29303

[21] Appl. No.: 220,691

[22] Filed: Dec. 29, 1980

[51] Int. Cl.[3] ..... E05D 7/10

[52] U.S. Cl. ..... 16/266

[58] Field of Search ..... 16/171, 176, 149, 169, 16/266

[56] References Cited

U.S. PATENT DOCUMENTS 853,384 5/1907 Tolnes ..... 16/149

2,315,488 4/1943 Aldeen ..... 16/169 X 4,237,577 12/1980 Chapel ..... 16/171 X

FOREIGN PATENT DOCUMENTS 75319 7/1949 Norway ..... 16/171

*Primary Examiner*—Werner H. Schroeder

*Assistant Examiner*—Andrew M. Falik

[57] ABSTRACT

A hinge assembly comprising two interfitting portions wherein a cylindrical shaft connects to a hollow cylinder to construct an operative hinge assembly.

1 Claim, 2 Drawing Figures

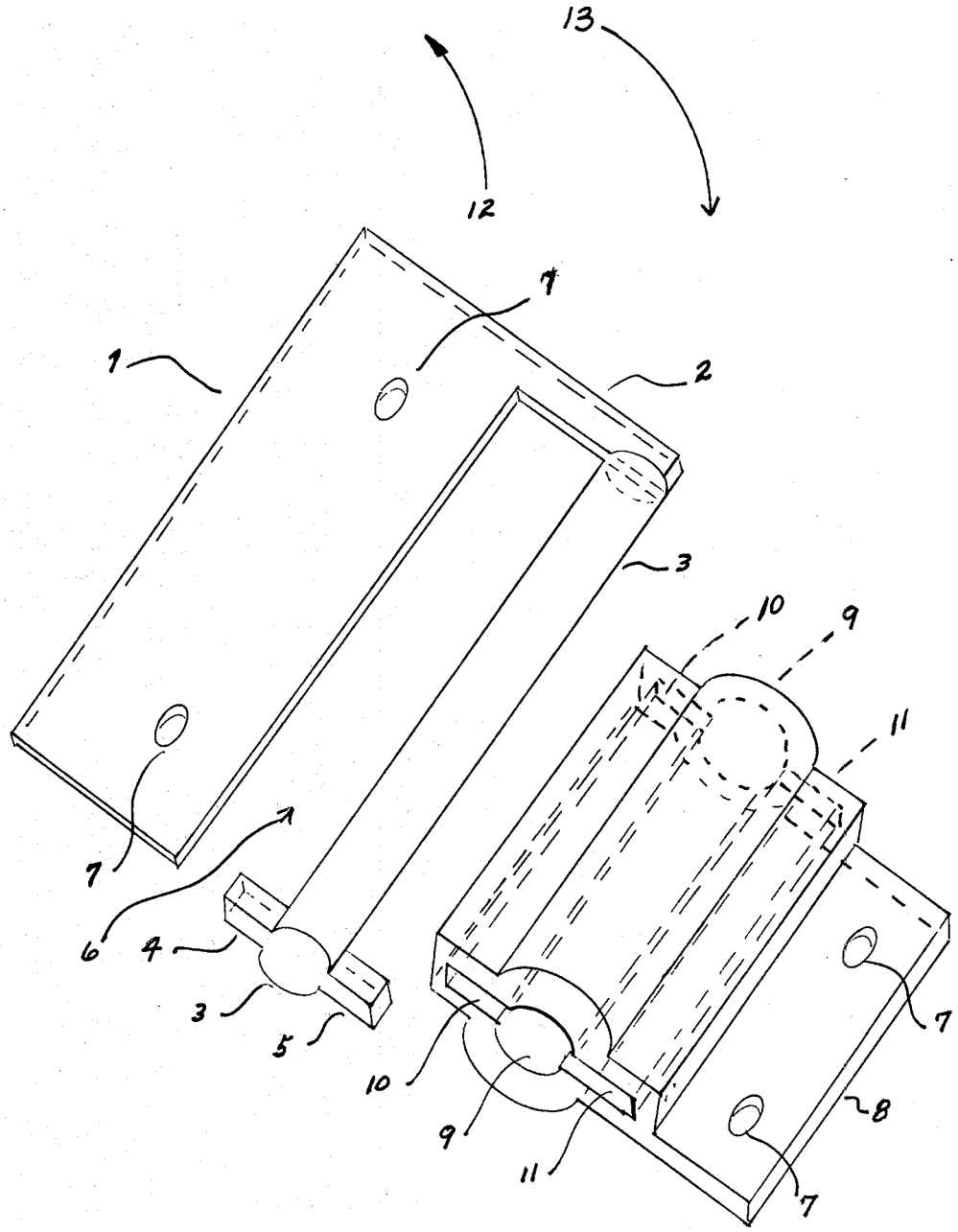
13
12
1
7
2
3
10
9
11
7
6
4
3
5
10
9
11
7
8
7

SEPARABLE HINGE

BACKGROUND OF THE INVENTION

Take apart hinges have been known for years however the construction of a two piece hinge that is preferably constructed from molded plastic where one piece includes a hollow cylinder and the pintle shaft portion is an integral part of the second piece, and wherein the two pieces can be disassembled by a specific shaft alignment is believed to be novel.

BRIEF SUMMARY OF THE INVENTION

It is therefore a primary object of this invention to provide a hinge assembly whereby the one shaft section of the hinge can be molded as an integral part of the work piece and the other housing section of the hinge can also be molded as an integral part of the other connecting work piece.

It is another object to provide a connecting hinge assembly whereby the two hinge sections can be joined together to construct an operative hinge assembly by properly positioning of the two hinge parts.

It is another object of the present invention to provide a hinge assembly in two parts that can be connected and dis-connected by properly positioning rather than by the conventional method of screw connecting the hinge to the work pieces.

It is another object to provide an inexpensive hinge assembly that can be molded into the work pieces and then joined together which has many applications in the plastic molding industries.

BRIEF DESCRIPTION OF THE INVENTION

The accompanying drawings, which are incorporated in and constitute a part of this specification illustrate one design of the invention and, therefore with a description serve to explain the principles of the invention.

FIG. I is a view of the shaft section of the hinge. (The male section of the hinge).

FIG. II is a view of the shaft's housing section of the hinge. (The female section of the hinge).

DETAILED DESCRIPTION OF THE INVENTION

Referring now to the drawings and more particular to FIG. 1 which represents the male or shaft section of the hinge having a flat rectangularly shaped base plate (1) with screw holes (7) so to affix to a work piece by screws and having an extended arm (2) that connects to a solid cylindrical shaft (3). The shaft (3) extending parallel to the base plate's (1) opposite end area and said shaft's end area having external keys (4 and 5) located on the shaft's end area that are positioned diametrically opposite each other, said shaft (3) and base plate (1) being in the same plane. The shaft (3) being extended from the base plate (1) forming a rotating area (6) for the shaft's housing (9) to revolve almost 360 degrees in a clockwise (13) or counter-clockwise (12) direction.

The other part of the section of the hinge as shown in FIG. 2 represents the female section of the hinge having a hollow cylinder (9) that is larger in circumference than the shaft (3) and said cylinder (9) having linear, and internal keyway grooves (10 and 11) that are located diametrically opposite the cylinder (9), said grooves being larger in area than the shaft's (3) external keys (4 and 5) and said cylinder (9) with grooves (10 and 11) being joined to a flat rectangularly shaped base plate (8) with screw holes (7). The length of the internal cylinder (9) with grooves (10 and 11) is smaller than the length of the shaft (3) so that the shaft's housing (FIG. 2) can be positioned over the shaft (FIG. 1) whereby the shaft's housing (9) will rotate around the shaft (3) to construct a hinge assembly.

When the housing (FIG. 2) is rotating around the shaft (3) it is unlikely that the housing (9) will slide off the shaft (3) since the housing must be in the stopped in an aligned position with the keys in order to disconnect.

Be it noted that when these two section of the hinge are molded or constructed into the work pieces as an intergal part that the base plates (1 and 8) will not be necessary.

While various designs may be made in the construction of this invention it is hoped that such changes will not alter the spirit and scope as is defined by the claims.

What is claimed:

1. A hinge assembly comprising two interfitting portions wherein the first portion includes a first base plate having an arm extending from one side that integrally connects to a first end of a cylinderical shaft, said shaft extending parallel to said base plate's one side and having a second free end with external keys thereon, said shaft and base plate being coplaner; and the second portion including a hollow cylinder affixed to a second base plate with the longitudinal axis of said cylinder being substantially coplaner thereto and wherein said cylinder includes internal keyway grooves adapted to slidingly receive the shaft's external keys, with the length of said cylinder being less than the length of said shaft and said shaft being sufficiently spaced from said base plate edge to allow said second portion to rotate almost 360 degrees around said shaft.

* * * * *